US009206631B2

(12) United States Patent
Lee

(10) Patent No.: US 9,206,631 B2
(45) Date of Patent: Dec. 8, 2015

(54) DEADBOLT SECURITY DEVICE

(71) Applicant: David Warren Lee, Newhall, CA (US)

(72) Inventor: David Warren Lee, Newhall, CA (US)

( * ) Notice: Subject to any disclaimer, the term of this patent is extended or adjusted under 35 U.S.C. 154(b) by 75 days.

(21) Appl. No.: 13/958,406

(22) Filed: Aug. 2, 2013

(65) Prior Publication Data

US 2014/0035299 A1 Feb. 6, 2014

Related U.S. Application Data

(60) Provisional application No. 61/679,425, filed on Aug. 3, 2012.

(51) Int. Cl.
*E05C 19/18* (2006.01)
*E05B 13/04* (2006.01)

(52) U.S. Cl.
CPC ..... *E05C 19/188* (2013.01); *E05B 13/04* (2013.01); *Y10T 292/34* (2015.04)

(58) Field of Classification Search
CPC ..... E05B 13/00; E05B 13/04; E05B 17/2007; E05B 17/2015; E05B 17/2023; E05C 19/186; E05C 19/188; Y10T 292/34
USPC ..... 292/288, 258, 289, 290–298, 305, 306, 292/342, 343, DIG. 37; 70/14, 416, 202, 70/211, 212, 429, 430
See application file for complete search history.

(56) References Cited

U.S. PATENT DOCUMENTS

| | | | | |
|---|---|---|---|---|
| 2,463,195 | A * | 3/1949 | Mungan | 70/416 |
| 3,458,228 | A * | 7/1969 | White | E05B 13/002 292/288 |
| 3,585,827 | A * | 6/1971 | Dominguez | 70/416 |
| 3,724,246 | A * | 4/1973 | Katsaros | 70/431 |
| 3,933,014 | A * | 1/1976 | Moses | 70/416 |
| 4,715,200 | A * | 12/1987 | Katsaros | 70/211 |
| 4,827,745 | A * | 5/1989 | Baugh | 70/416 |
| 5,000,498 | A * | 3/1991 | Upchurch | 292/288 |
| 5,035,128 | A * | 7/1991 | Ridgway | 70/211 |
| 7,377,135 | B2 * | 5/2008 | Copus | 70/14 |
| 2012/0222459 | A1 * | 9/2012 | Glazar | 70/91 |

* cited by examiner

*Primary Examiner* — Kristina Fulton
*Assistant Examiner* — Christine M Mills
(74) *Attorney, Agent, or Firm* — Plager Schack LLP

(57) ABSTRACT

A deadbolt security device clamps onto an interior deadbolt knob and prevents unlocking of the deadbolt door lock even with a key. While clamped onto the deadbolt knob the device has a shaft and a hook that extends around a door handle of the door to completely preventing turning of the deadbolt lock mechanism. This device is comprised of upper and lower clamp members that are movable toward each other to tightly grip the deadbolt interior knob or away from each other to permit easy removal of the device from the door.

9 Claims, 2 Drawing Sheets

DEADBOLT SECURITY DEVICE

BACKGROUND

Most homes are protected from entry by a deadbolt lock system. In many cases unwanted persons (ex-roommate, or former boyfriend or girlfriend, refugees of a relationship gone bad, etc.) may retain or obtain a key to the deadbolt lock. It would be desirable to keep those persons from being able to unlock the deadbolt and entire the residence or premises protected by the deadbolt lock. Alternatively, these deadbolt locks can be "picked" or opened using a "Bump" key, which can be easily purchased online. Such unkeyed methods of entry would also permit an undesired entry almost any existing deadbolt system.

Although conventional devices in this field do exist, they are not universal in their applicability to all or substantially all, deadbolt locks, or these conventional approaches require disassembly and reassembly of the existing deadbolt system. Experience with these conventional devices has led the Applicant to determine that are predominantly of very poor construction.

Improvements to these conventional devices and approaches to preventing unwanted access through a door secured by a deadbolt lock are desirable.

The present application relates generally to a device that clamps onto the interior deadbolt door lock thumb twist knob, preventing unlocking of the deadbolt door lock even with a key or when the lock is being picked. While clamped onto the deadbolt knob, the device of the present disclosure may incorporate a metal hook type arm that extends around the lower door handle to completely prevent turning of the deadbolt lock mechanism.

This device may be comprised of an upper and lower clamp system that secures the deadbolt interior knob. The device may also have two small thin steel plates on the back side of the clamp that when in place such that the plates are positioned behind the deadbolt knob itself. With the upper and lower portions secured about the deadbolt interior knob, the metal arm may then easily be adjusted to extend around the door handle. This arm may only need to be adjusted the first time it is used on a particular door, or if the device is moved to another door.

BRIEF DESCRIPTION OF THE DRAWINGS

The accompanying drawing figures, which are incorporated in and constitute a part of the description, illustrate several aspects of the present disclosure and together with the description, serve to explain the principles of the present disclosure. A brief description of the figures is as follows.

DETAILED DESCRIPTION

Reference will now be made in detail to exemplary aspects of the present disclosure which are illustrated in the accompanying drawings. Wherever possible, the same reference numbers will be used throughout the drawings to refer to the same or like parts.

Figure 1:
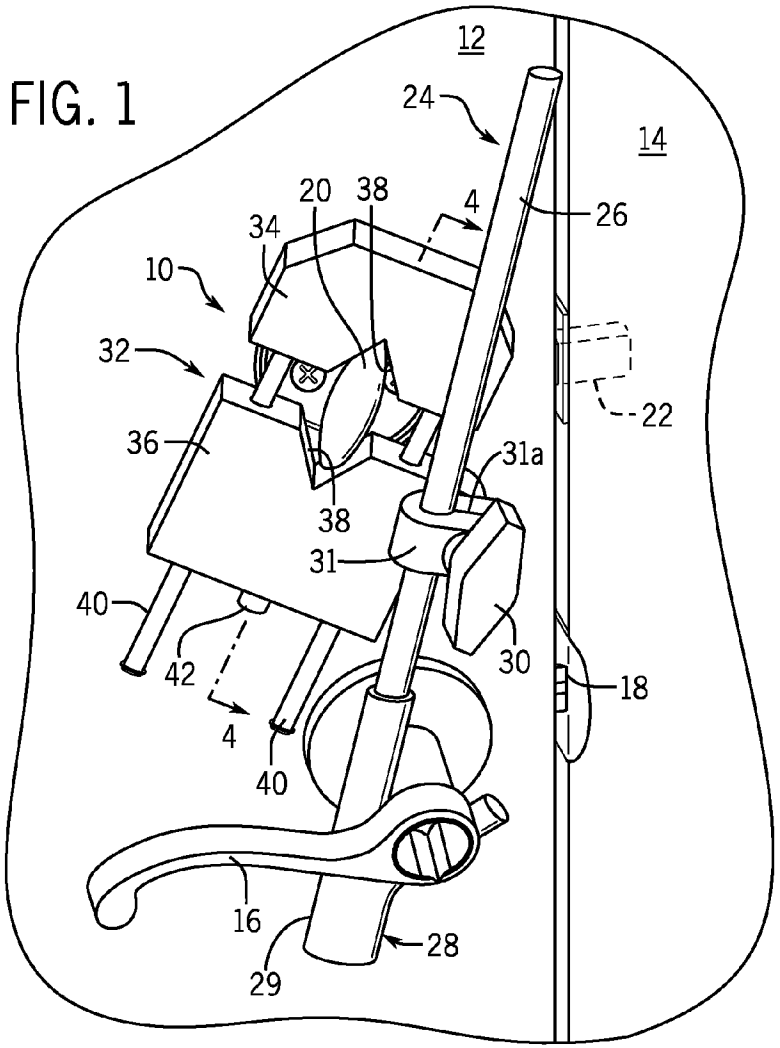
FIG. 1 is a perspective view of a deadbolt security device according to the present disclosure positioned about an interior knob of a deadbolt lock mounted to a door.

Referring now to FIG. 1, door 12 is shown with an interior deadbolt knob 20 which may be used to actuate the extension or refraction of a deadbolt 22. When extended, deadbolt 22 may extend into an opening in a door jamb 14 which may prohibit door 12 from being opened. In addition to the deadbolt mechanism, door 12 may further include a door handle 16 and a releasable latch 18 to permit the conventional opening and closing of door 12. Door handle 16 may or may not include a locking mechanism. Where it is felt that door handle 16 and latch 18 are not sufficient to provide security to door 12, retractable deadbolt 22 actuated by interior deadbolt knob 20 may be added to the door.

To provide additional security to deadbolt 22, and to prevent an unauthorized user with a key or an unauthorized user capable of opening deadbolt 22 without a key from passing through door 12, a deadbolt security device 10 may positioned about an interior deadbolt knob 20. Deadbolt security device 10 may include a clamping unit 32 comprising an upper clamping member 34 and a lower clamping member 36. Upper clamping member 34 and lower clamping member 36 may each include a notch 38 configured to fit about and engage interior deadbolt knob 20. When clamping unit 32 engages knob 20, the knob and clamping unit may be locked together and unable to turn independently from each other.

A pair of slider rods 40 may extend between the upper and lower clamping units and permit the clamping members to be separated to permit removal of device 10 from door 12 or permit placement of device 10 onto door 12. When the clamping unit 32 is placed about interior knob 20, lower clamp member 36 may be slid along slider rods 40 closer to upper clamp member 34 until knob 20 is engaged within notches 38. A ratchet or other releasable mechanism may be provided to permit lower clamp member 36 to be moved away from upper clamp member 34 to permit removal of device 10 from door 12. Such a releasable mechanism may be released or actuated by a release button 42.

Once the clamping unit 32 is positioned about and engaged with interior deadbolt knob 20, it is desirable that unit 32 be prevented from rotating to prevent the retraction of deadbolt 22. To accomplish this, a door handle hook arm 24 may be mounted to clamping unit 32 and may include a shaft 26 and a hook 28 at a distal end of shaft 26. To prevent rotation of clamping unit 32, hook 28 will preferably engage door handle 16. Even if a person outside of door 12 has an appropriate key to actuate the deadbolt lock mechanism and retract deadbolt 22, the engagement between hook 28 and door handle 16 will serve to prevent rotation of the deadbolt and opening of door 12.

Shaft 26 may be slidably mounted to clamping unit 32 by a slidable position clamp 31. Since the distance between interior deadbolt knob 20 and door handle 16 may vary depending on the size, shape and nature of use of door 12, it is desirable that security device 10 be adaptable to such different degrees of separation. Further, since the orientation of interior deadbolt knob 20 may not be consistent from door to door, it is also desirable that clamp 31 permit rotation of shaft 26 with regard to clamping unit 32 so that shaft 26 may be extended toward and engage door handle 16 on a wide variety of doors. Clamp 31 may include a simple slot 31*a* and a thumbscrew 30 that may be loosened to permit shaft 26 to be extended or shortened so that hook 28 is positioned to engage door handle 16. Once hook 28 is in place, thumbscrew 30 may be tightened down to secure device 10 to the door and prevent rotation of knob 20. It is anticipated that hook 28 may be coated by a protective material 29 to prevent scratching or marring of door 12 and/or door handle 16. Such a material 29 is not required for the functioning of device 10 within the scope of the present disclosure but may improve operation of the device. Such a material 29 may also serve to increase friction between door handle 16 and device 10 to further engage the resistance to rotation of interior deadbolt knob 20.

Figure 2:
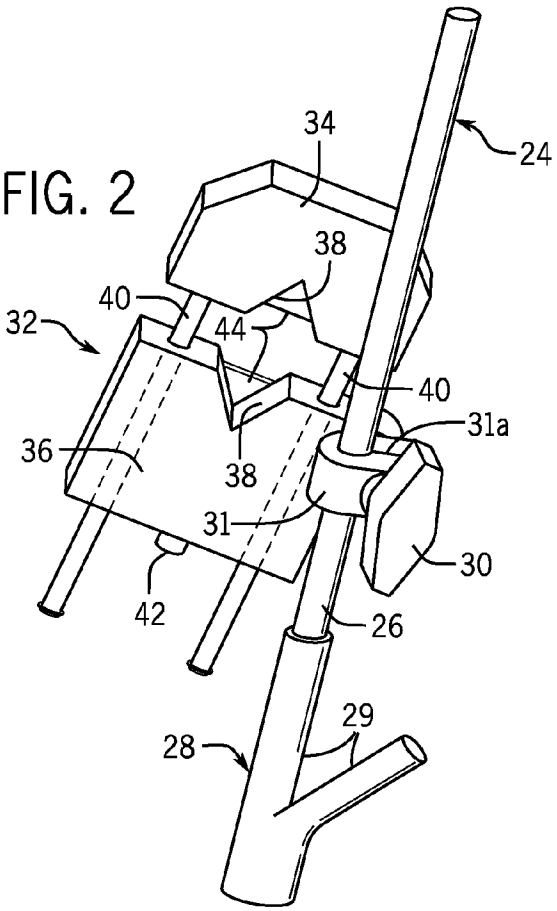
FIG. 2 is a perspective view of the deadbolt security device of FIG. 1.
Figure 4:
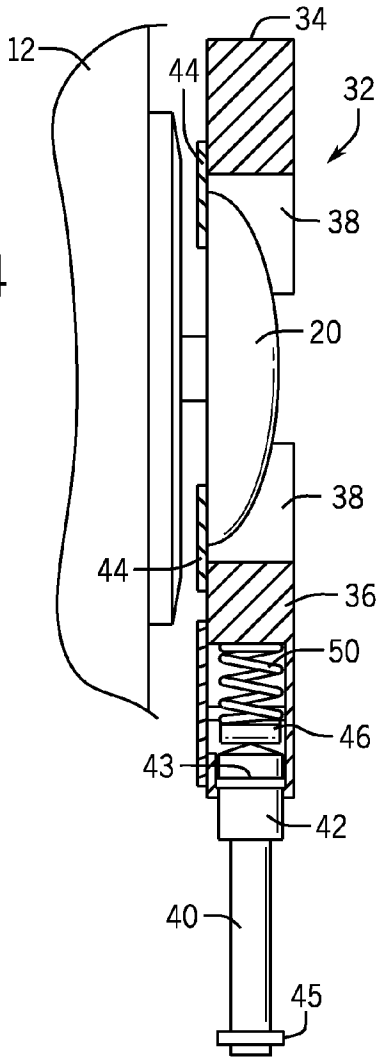
FIG. 4 is a cross-sectional view of the clamping unit of the deadbolt security device of FIG. 2, taken along line 4-4 in FIG. 1.
Figure 3:
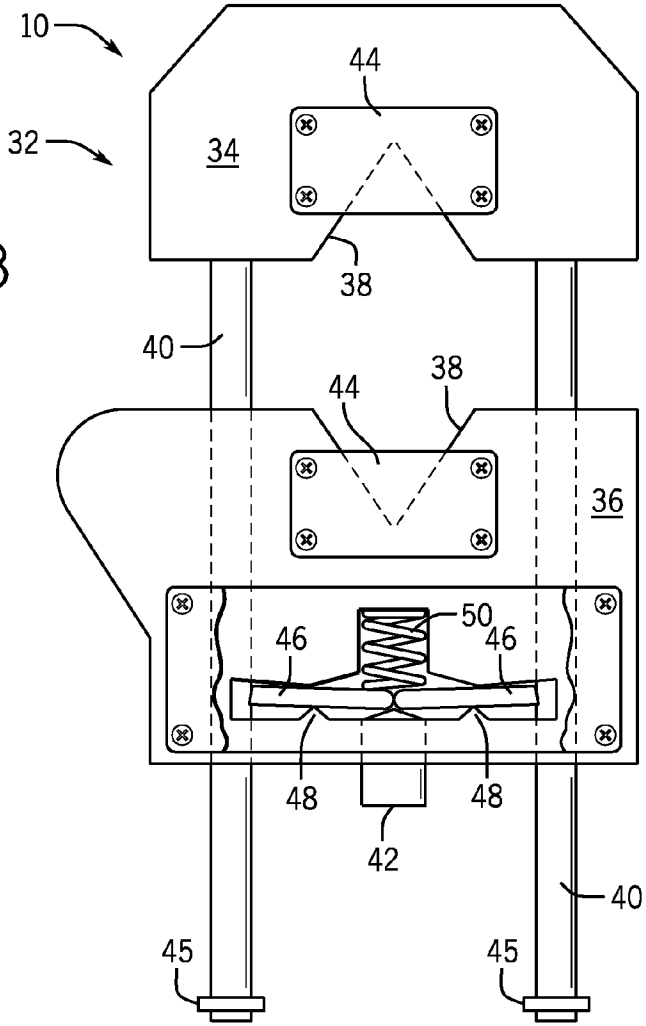
FIG. 3 is a rear view of a clamping unit of the deadbolt security device of FIG. 2.

Referring now also to FIGS. 2 to 4, clamping unit 32 may further include backing plates 44 adjacent notches 32 on one or both of upper clamp member 34 and lower clamp member 36. Backing plates 44 will be positioned preferably against door 12 when clamping unit 32 is positioned about interior deadbolt knob 20. Backing plates 44 may serve to prevent device 10 from being accidently or deliberately dislodged from door 12 when device 10 is being used to prevent actuation of interior deadbolt knob 20. As shown in FIG. 4, backing plates 44 extend behind interior deadbolt knob 20 when device 10 is positioned on door 12.

As shown in FIGS. 3 and 4, within lower clamp member 36 may be a releasable mechanism to permit or prevent the movement of lower clamp member 36 along slider rods 40. Such a mechanism may include a pair of tabs 46 extending within a cavity include lower clamp member 36 between an interior end of button 42 and engaging slider rods 40. A spring 50 may be included within lower clamp member 36 to bias button 42 and inboard ends of tabs 46 outward. Button 42 may include a retaining ring 43 to prevent spring 50 form forcing button 42 entirely out of lower clamp member 36. An outboard end of each tab 46 may be positioned to engage one of the slider rods 40. A fulcrum 48 may be provided within the cavity through which tabs 46 extend, with each fulcrum 48 positioned generally equidistant between button 42 and rods 40.

With button 42 and the inboard ends of tabs 46 positioned where biased by spring 50, engagement of the outboard ends of tabs 46 and slider rods 40 within lower clamp member 36 will preferably prevent movement of upper clamp member 34 and lower clamp member 36 away from each other. This will help secure deadbolt security device 10 to door 12 and prevent accidental or deliberate dislodging of the device. To release device 10 from door 12, a user would press inward on button 42 to overcome the spring's bias outward and move button 42 into lower clamp member 36. In this position, the engagement between tabs 36 and rods 40 would be released enough to permit movement of lower clamp member 36 along rods 40 either toward or away from upper clamp member 34. Each slider rod 40 may include a stop ring 45 at a distal end to prevent removal of lower clamp member 36 from rods 40.

Referring now to FIG. 1, when device 10 is first positioned on door 12, the upper and lower clamp members would be far enough apart to permit interior deadbolt knob 20 to be positioned past backing plates 44 and within notches 38. Once knob 20 was in position between the upper and lower clamp members, button 42 may be depressed and lower clamp member 36 may be slid along slider rods 40 until knob 20 is closely engaged by notches 38. When the notches a closely engaging knob 20, button 42 may be released and spring 50 will urge the outboard ends of tabs 46 against road 40 and prevent further movement of the clamp members with respect to each other. Once clamping unit 32 is desirably positioned about knob 20, shaft 26 may be rotated and moved within clamp 31 so that hook 38 will engage door handle 16. When shaft 26 and hook 28 are positioned as desired to engage the door handle and prevent rotation of clamping unit 32, thumbscrew 30 may be tightened up to lock hook 28 in place.

To remove security device 10 from door 12, button 42 would be depressed so that lower clamp member 36 may be moved away from upper clamp member 34 sufficiently to disengage with knob 20. If clamp 31 is mounted to lower clamp member 36, such movement will also preferably disengage hook 28 from door handle 16. Thus, removal of security device 10 may be accomplished simply by separating the clamp members along rods 40. When repositioning device 10 to door 12, the positioning of hook 28 and shaft 26 will preferably not be required, and hook 28 will be positioned to engage door handle 16 when the clamping members are again positioned closely about knob 20.

The security device of the present disclosure differs from what currently exists in that this device is very sturdy and very easy to use. Device 10 requires no permanent installation on door 12 and further does not require disassembly and reassembly of the deadbolt mechanism to be used. Further, the security device of the present application is completely universal in nature, being adaptable for use with almost any common door, door handle and deadbolt knob configuration or positioning. Many people don't have the mechanical know how to install a conventional system that requires disassembly of the existing deadbolt system. Other conventional devices are known to break (due to poor construction) or even fall off the deadbolt interior knob.

Device 10 may be simply clamped onto inside deadbolt knob 20 on door 12 using minimal pressure. Once clamped, shaft 26 and hook 28 are simply adjusted in place also using minimal pressure. These functions may be accomplished by almost any person of any age with ease. When installed, security device 10 will render the deadbolt lock mechanism immobile. Push button 42 will permit the easy release of security device in mere seconds, also with minimal pressure.

Applicant anticipates that any number of suitable materials may be used to construct the security device according to the present disclosure and no limitation is intended within this disclosure with regard to the materials from which the device may be made.

While security device 10 has been described as including a pair of sliding rods 40, it is anticipated that a security device having one rod or a plurality of rods may be configured according to the present application and it is not intended to limit the present disclosure to any particular number of rods. By the use of the word rod, Applicant is not intending to limit the present application to any particular size or shape of element(s) extending between the clamp members and permit movement of the clamp members with respect to each other. It is further anticipated that any number of releasable mechanisms may be used to fix one or both of the clamp members to the rod(s) extending between the clamp members. It is preferable that such mechanism be actuated without tools but beyond that it is not intended to limit the nature of the releasable mechanism.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A deadbolt security device for securing and preventing rotation of an interior deadbolt knob of a door, the deadbolt security device comprising:

an upper clamp member and a lower clamp member and at least one rod extending between the clamp members, the clamp members being moveable along the at least one rod toward and away from each other;

each clamp member including a notch, the notches cooperating to define a space between the clamp members to receive an interior deadbolt knob, the notches configured to engage the interior deadbolt knob as the clamp members are moved toward each other and prevent the movement of the interior deadbolt knob unless the clamp members are also moved; and a shaft coupled to one of the clamp members by a releasable clamp and comprising a hook on a distal end of the shaft, the releasable clamp configured to permit the shaft to slidably adjust and rotate through the releasable clamp relative to the clamp members to permit the hook of the shaft to engage a door handle of the door when the clamp members engage the interior deadbolt knob of the door, wherein the engagement of the hook and door handle prevents rotation of the clamp members and the interior deadbolt knob.

2. The deadbolt security device of claim 1, further comprising a releasable mechanism engaging the at least one rod, the releasable mechanism permitting movement of the lower clamp member toward and away from the upper clamp member when released and securing the upper and lower clamp members with respect to each other when engaged.

3. The deadbolt security device of claim 2, further comprising the releasable mechanism actuated by a push button.

4. The deadbolt security device of claim 2, further comprising the clamp mounted to the lower clamp member and the shaft extending from the lower clamp member, the lower clamp member further including the releasable mechanism.

5. The deadbolt security device of claim 1, further comprising a pair of rods extending between the upper and lower clamp members.

6. The deadbolt security device of claim 1, further comprising a backing plate within each notch, the backing plate positioned between the interior deadbolt knob and the door when the clamp members are engaging the interior deadbolt knob.

7. The deadbolt security device of claim 1, further comprising the hook coated with a material selected to prevent damage to the door.

8. The deadbolt security device of claim 1, wherein the at least one rod includes a first rod and a second rod and wherein the upper clamp member and lower clamp member are both slidably mounted to the first rod and the second rod.

9. The deadbolt security device of claim 8, further comprising a releasable mechanism engaging the first and second rods, the releasable mechanism comprising a spring actuated button coupled to the lower clamp member and operably connected to a first tab releasably engaged with the first rod and a second tab releasably engaged with the second rod, wherein the spring actuated button in a first position enables the first and second tabs to engage with the first and second rods, thereby preventing movement of the lower clamp member relative to the upper clamp member, wherein the spring actuated button in a second position enables the first and second tabs to disengage from the first and second rods, thereby permitting movement of the lower clamp member relative to the upper clamp member.

* * * * *